US006109864A

United States Patent [19]

Schofield et al.

[11] Patent Number: 6,109,864

[45] Date of Patent: Aug. 29, 2000

[54] VACUUM PUMPS

[75] Inventors: Nigel Paul Schofield, Horsham; Ian Stones, Crawley, both of United Kingdom

[73] Assignee: The BOC Group plc, Windlesham, United Kingdom

[21] Appl. No.: 09/151,630

[22] Filed: Sep. 11, 1998

[30] Foreign Application Priority Data

Sep. 15, 1997 [GB] United Kingdom ..... 9719634

[51] Int. Cl.[7] ..... F04D 19/04; F01D 1/36

[52] U.S. Cl. ..... 415/90; 415/199.5; 415/208.2; 415/209.1; 415/211.2

[58] Field of Search ..... 415/90, 191, 193, 415/208.2, 185, 199.5, 209.1, 210.1, 211.2; 417/423.4

[56] References Cited

U.S. PATENT DOCUMENTS 940,103 11/1909 Feld ..... 415/90

4,655,680 4/1987 Klepesch ..... 415/90

FOREIGN PATENT DOCUMENTS 1-301992 12/1989 Japan ..... 417/423.4

1366709 1/1988 U.S.S.R. ..... 415/90

*Primary Examiner*—Christopher Verdier

*Attorney, Agent, or Firm*—Salvatore P. Pace

[57] ABSTRACT

A turbo-molecular vacuum pump comprising alternate first and second stages. The first stage comprises a plurality of blades arranged in an annular envelope with the blades depending radially from a disc and being angled about radial lines out of the plane of the disc. The second stage comprises a plurality of coaxial, concentric frusto-conical members arrayed in a plane parallel to that of the annular envelope such that at least some of the blades and at least some of the frusto-conical members are axially aligned and are adapted to remain so during rotation of one stage relative to the other.

7 Claims, 2 Drawing Sheets

VACUUM PUMPS

BACKGROUND OF THE INVENTION

This invention relates to vacuum pumps and, more particularly, to vacuum pumps comprising or incorporating turbo-molecular pumping stages.

A conventional turbo-molecular stage arrangement of a vacuum pump comprises a stack of alternate rotors and stators. Each stage effectively comprises a solid disc with a plurality of blades depending (nominally) radially therefrom; the blades are evenly spaced around the circumference of the disc and angled "about" radial lines out of the plane of the disc in the direction of rotation of the rotor stage.

The rotor and stator blades have positive and negative gradients respectively when viewed from the side in to a radial line of the disc. This arrangement has the effect in highly viscous flow conditions of causing rapid changes in the flow direction, resulting in high power consumption.

In molecular flow conditions, the performance of a conventional turbo-molecular pump is attributable to certain molecules of gas being pumped by the alternate rotor-stator pairs in the following way:

i) gas at the inlet has random motion, ii) rotating blades on (say) the inlet stage (rotor) provide a higher transmission probability downwards rather than upwards due to blade angle and relative blade velocity, thereby generating compression, iii) gas in to the next stage has a velocity component in rotor direction equivalent to rotor velocity, iv) stationary blades on the next stage (stator) again provides a higher transmission probability downwards than upwards due to blade angle and relative gas velocity, thereby again generating compression, v) gas exiting the stator stage has no relative velocity, i.e. random motion again.

It should be noted that certain other molecules of gas being pumped, in molecular flow conditions, do not interact with each stage of the pump but pass through some stages unaffected.

If the pump comprised only rotor stages, there would exist no relative velocity between the gas and the rotating blades after leaving the surface of the first rotor and therefore no preferential gas direction through the second (and subsequent) rotors.

Thus a pump consisting solely of rotors (or solely of stators) would generate very little or no compression although power consumption would be reduced dramatically.

Both rotors and stator stages are therefore clearly necessary in a turbo-molecular pump arrangement; the function of each stage is two-fold.

a) to provide compression from blade angle and relative velocity, and b) to redirect gas molecules to sustain a relative velocity between the gas and the blades for each stage through the pump.

Turbo-molecular vacuum pumps are designed to operate at high rotational speeds of the shaft to which the rotor discs are attached and to achieve high levels of vacuum in the chambers to which they are attached. Turbo-molecular pumps are generally unable to deliver gases directly to the atmosphere; the use of a backing pump of different pumping mechanism which pumps down or "roughs" the pressure in the chamber, preferably prior to the operation of the turbo-molecular pump, and in to the inlet of which the output of the turbo-molecular pump is subsequently directed, is therefore generally needed.

The backing pump may alternatively be incorporated in to the turbo-molecular pump body to form a compound vacuum pump. For example, the turbo-molecular pump stages may be followed, in order of gas flow through the pump as a whole, by one or more molecular drag stages, for example those known as "Gaede" stages or "Holweck" stages, and regenerative stages to exhaust to atmospheric pressure.

A compound design incorporates the different pump stages/mechanisms, the rotors of which are all rigidly mounted on a single shaft and each mechanism being suited to pumping in different vacuum pressure regions. As such, the combination of mechanisms provide a steady pressure gradient through the pump as a whole from inlet to outlet.

The major consideration of a compound design is the electrical power required during the initial pump down. Prior to the pressure gradient being established across the pump, all mechanisms are required to rotate at atmospheric pressure. In this condition, conventional turbo-molecular blades—whether in a simple single mechanism pump or in a compound pump—generate large viscous shear and turbulence effects between the rotors and the stators resulting in high and often impractical levels of power consumption; the faster the pump shaft speed, the greater is the power consumption. Reducing the number of turbo-molecular stages although reducing power consumption would simply adversely affect the pump performance.

Where sufficient shaft speeds can be attained during initial operation of the pump, the mechanisms suited to pumping in viscous flow conditions begin to reduce the upstream pressure in the pump and thereby reduce the power required to rotate the turbo-molecular blades. The shaft speed can then increase and the pressure at the pump inlet can reduce further.

There is a need to minimise the atmospheric pressure power consumption of the turbo-molecular portion of a compound pump or as a part of a turbo-molecular roughing pump system without redress to the simple expedient of reducing the number of turbo-molecular stages.

The invention addresses this need through modified turbo-molecular pump design by substantially or completely eliminating turbulence and viscous shear, thereby allowing an adequate number of turbo-molecular stages to be employed for good pumping performance without the requirement of excessive power consumption.

SUMMARY OF THE INVENTION

In accordance with the invention, there is provided a turbo-molecular vacuum pump comprising alternate first and second stages in which the first stage comprises a plurality of blades arranged in an annular envelope with the blades depending radially from a disc and angled about radial lines out of the plane of the disc and the second stage comprises a plurality of co-axial, concentric frustoconical members arrayed in a plane parallel to that of the annular envelope such that at least some of the blades and at least some of the frusto-conical members are axially aligned and are adapted to remain so during rotation of one stage relative to the other.

In general the rotor stage is attached to, and arrayed centrally about, a pump shaft adapted for rotation at high speed about its main axis, and the stator stage is attached to the pump body and also arrayed centrally about the main axis of the pump shaft.

The blades of the first stage are preferably attached to a central disc and depend radially therefrom to form the annular envelope and angled in the direction of travel of the rotor in a manor known per se. The blades should be evenly spaced around the outer periphery of the disc. Typically, there may be about twenty blades in a useful array for this first stage.

The frusto-conical members of the second stage are preferably formed in a coplanar fashion about a central disc and are preferably attached thereto and to each other by means of thin struts. Typically there may be from two to five frusto-conical members in the second stage.

Clearly the annular envelope of the first stage and the frusto-conical array of the second stage should be co-axially mounted in the pump and axially aligned with respect to each other during rotation of one stage relative to the other such that a gas flow path can be established through the various stages of the pump.

In preferred embodiments the first stage (blades) comprises the rotor and the second stage (frusto-conical members) comprises the stator and the radially depending blades are angled about the radial lines of the disc in a direction of rotation of the rotor, i.e. such that gas molecules passing through the first stage are urged through the pump.

In such preferred embodiments, in viscous flow conditions the conical members do not interact with the body of gas associated with the spinning rotor blades as significantly as in the conventional design of pump. In fact little turbulent mixing occurs and electrical power consumption is low.

In molecular flow conditions, the operation of the pump can be represented as follows:

i) gas at the inlet has purely random motion, ii) at the first rotor stage, the rotating blades generate a higher transmission probability downwards than upwards due to the blade angle and relative blade velocity and hence, as in conventional designs, generates compression.

iii) gas in to the next (frusto-conical) stage has a velocity component in the rotor direction equivalent to rotor velocity so that when the gas enters the stage—having moved tangentially some distance from the previous rotor—it also has a radial component of velocity.

iv) observed in a diametric section, the stator conical members behave like conventional "radial" blades and provide a relative velocity equal to the radial component of the gas velocity. The effective blade angle and spacing is similar to that used in conventional radial blades. The radial component of the velocity in the conical members provides a higher transmission probability downwards than upwards and thereby generates compression of the gas.

v) gas leaving the stator stage has no relative velocity in the direction of rotation and therefore the gas resumes random motion.

Such an arrangement of the stages and a reverse arrangement of the stages as stator and rotor, requires a significantly reduced power consumption for atmospheric pressure operation but, surprisingly without significant loss of overall performance at lower pressure (higher vacuum) operation. Each stage achieves the two basic previously stated functions required of them, i.e. to provide compression and to redirect molecules.

The radial stage(s) behave in substantially identical fashion to conventional radial blades, generating compression and providing suitable gas molecule direction. The conical stage(s) also aid re-direction of the gas molecules between the radial stages to support the relative velocity requirements which enable the radial stages to operate effectively. The radial component of velocity entering the conical stage is significantly lower than the tangential rotor velocity and, as a result, a compression will be generated but will be somewhat lower than for the radial blades of a conventional design of pump. The reduction does not, however, reduce the acceptability of overall pump performance.

In certain other preferred embodiments, the pump of the invention can be improved further by allowing a greater separation between the blades of the first stage and the conical members of the second stage, for example increased from the spacing in a conventional pump of 3 mm to 4 mm to a higher spacing of up to about 10 mm, for example about 5 mm to about 10 mm. This allows gas molecules to possess a higher proportion of radial velocity before entering the conical stator members and further reduces the shear generated in viscous flow.

In addition, the blades of the rotor stage may be angled, in addition to that effected in a circumferential direction relative to a plane of the ring in that they are arrayed, to sweep back so that their main axes no longer lie on a radial line. This generates a non-tangential trajectory bias for the molecules leaving the blades, thereby increasing the radial velocity component in to the conical members and improving pumping performance overall.

BRIEF DESCRIPTION OF THE DRAWINGS

For a better understanding of the invention, reference will now be made, by way of exemplification only, to the accompanying drawings, in which.

DETAILED DESCRIPTION

Figure 1:
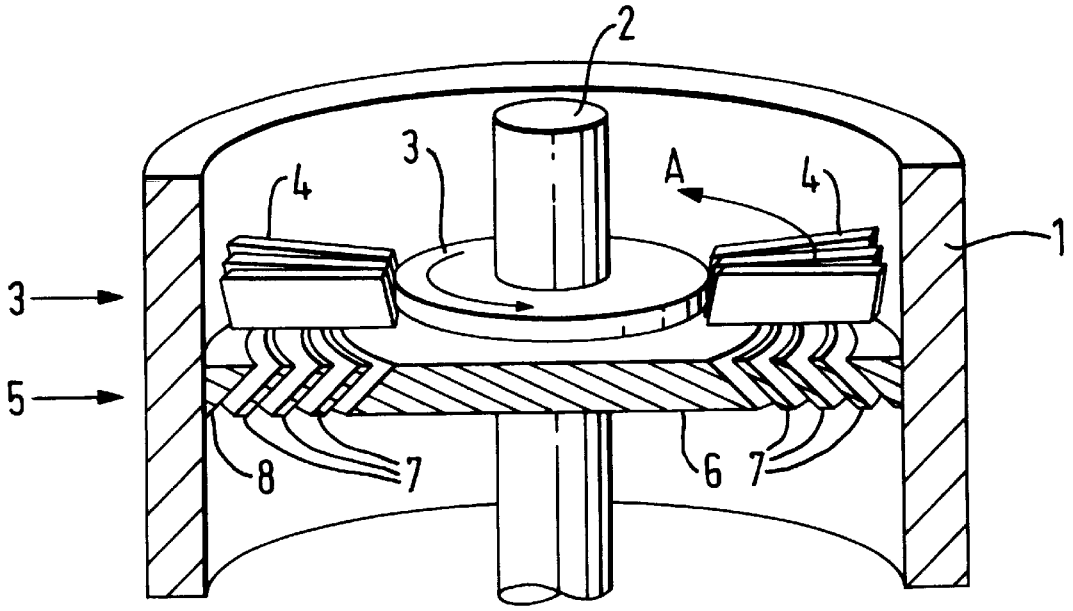
FIG. 1 is schematic perspective cross-sectional view of a vacuum pump of the invention showing part of a radial blade stage and a conical stage.
Figure 2:
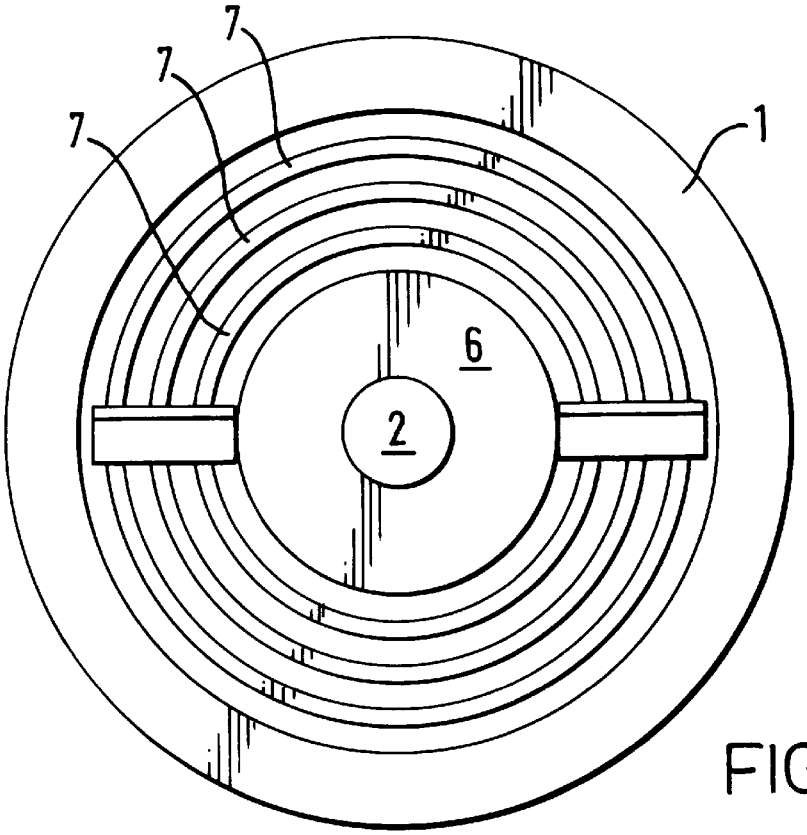
FIG. 2 is a plan view of the pump shown in FIG. 1.

With reference to the drawings and to FIGS. 1 and 2 in particular, there is shown a vacuum pump of the invention comprising a pump body 1 of circular cross section and having mounted therein by bearing means (not shown) a shaft 2 which is adapted for rotation at high speed about its longitudinal axis (and that of the body 1) by a motor (not shown).

Fixed to the shaft 2 is a first pump stage 3—the rotor stage in this example—comprising a solid disc 3 to which are attached a plurality of blades 4 evenly spaced in an annular envelope around the periphery of the disc 3 (only some are shown in the drawings for reasons of clarity). The centre line of each blade 4 lies on a radial line emanating from the disc 3 but the blades themselves are angled in the direction of rotation of the blades indicated by the arrow A (and as shown in the top stage of FIG. 3), i.e. the blades are rotated about their radial axis (centre line) by, say, 30°, such that gas molecules striking the blades are urged through the stage and through the pump generally.

Beneath the first stage 3 is a second stage 5—the stator stage—comprising a solid disc 6 having a central aperture within which the shaft rotates, which is surrounded in a radial plane by a plurality (three) of co-axial, concentric, frustoconical, hollow members 7 and an outer member 8; the outer member 8 is of circular cross section and is fixed to the inside surface of the body 1.

The members 7 and 8 and the disc 6 are held stationary in a radial plane (at right angles to the shaft axis) by means of linking struts not shown. Angled, evenly-spaced annular gaps are therefore formed between the members 7 and 8 and the disc 6 as shown most clearly in FIG. 1.

It is important that there is an alignment in a radial sense between the blades and the annular gaps between the members 7 and 8 sufficient to allow a substantially axial pathway to be formed through the different stages of the pump.

Figure 3:
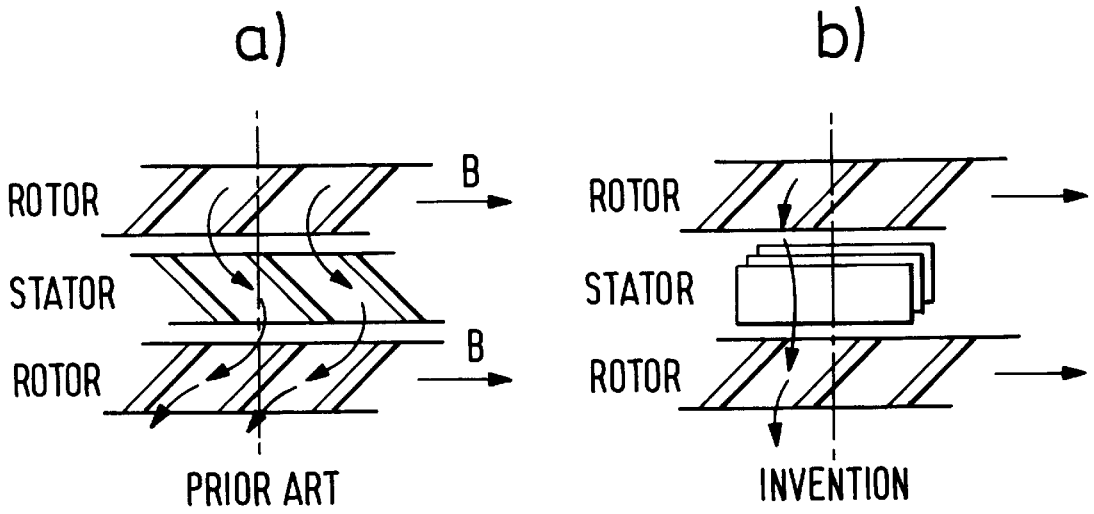
FIG. 3*a* shows schematically a conventional turbomolecular pump.
FIG. 3*b* shows a vacuum pump of the invention.

FIG. 3 shows, in the prior art left-hand part a) the direction of flow of gas through a three stage conventional pump arrangement, i.e. each stage comprising blades angled in alternate fashion from stage to stage with the two rotor stages moving in the direction of the arrows B. The flow is in accordance with the general prior art description provided in the introduction above.

Part b) of FIG. 3 shows the direction of flow through two rotor stages and a stator stage of a pump of the invention, again in accordance with the general invention description provided in the introduction above.

Figure 4:
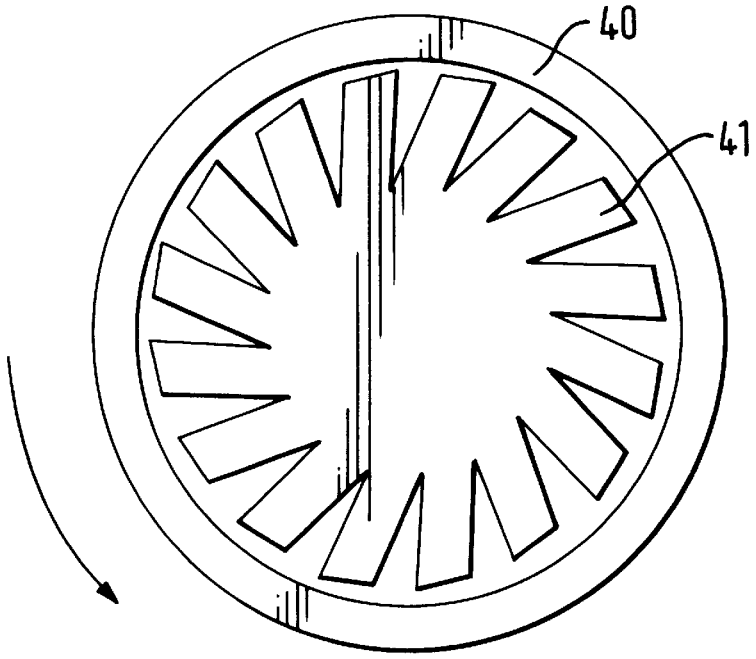
FIG. 4 is a plan view of a modified blade stage rotor in accordance with the invention.

FIG. 4 shows a modified bladed rotor for incorporation in to a vacuum pump of the invention. The pump has a body 40 with the rotor 41 mounted on a shaft (not shown) for rotation therein adjacent to a stator stage (5) in the general manner shown in FIG. 1. However, although the blades 41 have their centre line in the planes of the rotor, i.e. perpendicular to the longitudinal axis of the shaft and the blades are again rotated about their centre line as shown generally in FIG. 3 the blades are also angled within the plane of the rotor so that they are "swept back" with regard to radial lines of the rotor and no longer lie on the radial lines. This arrangement of blades generates a non-tangential trajectory bias for gas molecules leaving the blade surface in molecular flow conditions, thereby increasing the radial velocity component in to the cones and therefore improving pump performance overall.

With regard to the specific embodiments shown in the drawings and generally, a relatively large rotor to stator separation can be used, for example up to 10 mm, in comparison to the separation normally deemed useful in conventional turbomolecular pumps (1–3 mm). The separation is the gap between—see FIG. 1 in particular—the lowest part of the blades 4 of the rotor and the highest part of the members 7, 8.

We claim:

1. A turbo-molecular vacuum pump comprising:

alternate first and second stages; the first stage comprising a plurality of blades arranged in an annular envelope with the blades depending radially from a disc and being angled about radial lines out of the plane of the disc; and the second stage comprising a plurality of co-axial, concentric frustoconical members arrayed in a plane parallel to that of the annular envelope such that at least some of the blades and at least some of the frustoconical members are axially aligned and are adapted to remain so during rotation of one stage relative to the other.

2. The turbo-molecular vacuum pump according to claim 1 in which the rotor stage is attached to, and arranged centrally about, a pump shaft adapted for rotation at high speed about its main axis, and the stator stage is attached to a body of the pump and also arranged centrally about the main axis of the pump shaft.

3. The turbo-molecular vacuum pump according to claim 1 in which the frusto-conical members of the second stage are formed in a co-planar fashion about a central disc.

4. The turbo-molecular vacuum pump according to claim 1 in which there are from between two and five frustoconical members in the second stage.

5. The turbo-molecular pump according to claim 1 in which the blades of the first stage comprises the rotor;

the frusto-conical members of the second stage comprises the stator and the radially depending blades are angled about the radial lines of the disc in a direction of rotation of the rotor.

6. The turbo-molecular vacuum pump according to claim 1 in which the separation between the blades of the first stage and the conical members of the second stage are each from between about 5 mm and about 10 mm.

7. The turbo-molecular vacuum pump according to claim 1 in which the blade of the rotor stage are angled to sweep back.

* * * * *